US005857582A

United States Patent [19]

Schulz

[11] Patent Number: 5,857,582

[45] Date of Patent: Jan. 12, 1999

[54] PACKAGE COMPRISING A TRAY-SHAPED BOTTOM PART AND A COVER

[75] Inventor: Werner Schulz, Horsens, Denmark

[73] Assignee: Danisco A/S, Copenhagen, Denmark

[21] Appl. No.: 913,067

[22] PCT Filed: Mar. 14, 1996

[86] PCT No.: PCT/DK96/00101

§ 371 Date: Sep. 17, 1997

§ 102(e) Date: Sep. 17, 1997

[87] PCT Pub. No.: WO96/28363

PCT Pub. Date: Sep. 19, 1996

[30] Foreign Application Priority Data

Mar. 15, 1995 [DK] Denmark ..... 0257/95

[51] Int. Cl.[6] ..... B65D 17/34

[52] U.S. Cl. ..... 220/269; 220/339; 220/359.2; 220/359.3

[58] Field of Search ..... 220/359.1, 359.2, 220/359.3, 359.4, 268, 269, 276, 339; 215/232, 349, 350, 351

[56] References Cited

U.S. PATENT DOCUMENTS

| | | | |
|---|---|---|---|
| 1,320,757 | 11/1919 | Hothersall . | |
| 2,736,656 | 2/1956 | Marshall . | |
| 2,925,188 | 2/1960 | Grumbles . | |
| 2,986,322 | 5/1961 | Atkinson . | |
| 3,154,225 | 10/1964 | Wadlinger et al. . | |
| 3,166,234 | 1/1965 | Amberg . | |
| 3,235,165 | 2/1966 | Jackson . | |
| 3,381,884 | 5/1968 | Herrity . | |
| 3,547,338 | 12/1970 | Hemmes . | |
| 3,893,566 | 7/1975 | Ross . | |
| 3,942,676 | 3/1976 | Beckers et al. . | |
| 3,977,562 | 8/1976 | Wedzik . | |
| 3,990,603 | 11/1976 | Brochman | 220/260 |
| 3,997,677 | 12/1976 | Hirsch et al. . | |
| 4,141,487 | 2/1979 | Faust et al. . | |
| 4,189,060 | 2/1980 | Trotman, III | 220/260 |
| 4,244,488 | 1/1981 | Fridl et al. | 220/260 |
| 4,453,666 | 6/1984 | Gordon . | |
| 4,673,085 | 6/1987 | Badouard et al. . | |
| 4,673,126 | 6/1987 | Hambleton . | |
| 4,771,935 | 9/1988 | Hekal . | |
| 5,265,745 | 11/1993 | Pereyra et al. | 215/232 |

FOREIGN PATENT DOCUMENTS

| | | |
|---|---|---|
| 160702 | 4/1991 | Denmark . |
| 0 007 971 | 2/1980 | European Pat. Off. . |
| 0 093 442 | 11/1983 | European Pat. Off. . |
| 305976 | 3/1989 | European Pat. Off. . |
| 0 488 452 | 6/1992 | European Pat. Off. . |
| 319186 | 11/1902 | France . |
| 2 577 897 | 8/1986 | France . |
| 21 40 733 | 2/1973 | Germany . |
| 28 40 223 | 3/1979 | Germany . |
| 563284 | 6/1975 | Switzerland . |
| 1 401 471 | 7/1975 | United Kingdom . |
| 2 169 261 | 7/1986 | United Kingdom . |
| WO 86/03474 | 6/1986 | WIPO . |

*Primary Examiner*—Stephen K. Cronin
*Attorney, Agent, or Firm*—Sterne, Kessler, Goldstein & Fox P.L.L.C.

[57] ABSTRACT

A package comprising a tray-shaped bottom part (1) provided with an opening covered by a cover (2) being sealed to the bottom part (1) along a circumferential rim (10) so as to form a sealed compartment. With a view to forming a peelable cover part (15), the cover (2) is peelably sealed to the bottom part (1) along a portion of the rim thereof by means of a first sealing line. The first sealing line extends between two terminal points arranged on a line (23) extending across the opening of the bottom part (1). Moreover, the cover (2) is sealed firmly to the rim (10) of the bottom part (1) at least in the rim portions of the bottom part immediately adjacent said points by means of other sealing lines. At least in the portion of said line (23), the cover (15) is formed of a first flexible plastic sheet (14). The peelable cover part (15) is formed more rigid than the first plastic sheet (14) at least in the portion being furthest spaced apart from the connecting line (23) between the two terminal points.

8 Claims, 4 Drawing Sheets

PACKAGE COMPRISING A TRAY-SHAPED BOTTOM PART AND A COVER

TECHNICAL FIELD

The invention relates to a package comprising a tray-shaped bottom part provided with an opening covered by a cover sealed to the bottom part along a circumferential rim thereof so as to form a sealed compartment, and wherein the cover to form a peelable cover part is peelably sealed to the bottom part along a portion of the rim thereof by means of a first sealing line extending between two terminal points arranged on a line extending across the opening of the bottom part, and wherein the cover is firmly sealed to the rim of the bottom part by means of other sealing lines, at least in the rim portions of the bottom part immediately adjacent said points, and wherein the cover part at least in the portion of said line is formed of a first flexible plastic sheet.

The term tray-shaped bottom part should be understood in the broadest sense, as the bottom part may be essentially completely flat, i.e. without side walls or be very deep, i.e. have essentially higher side walls than illustrated on the drawing.

BACKGROUND ART

Danish patent application No. 1524/92 discloses a package of the above type, in which the peelable cover part extends in an overlapping manner onto a cover part sealed to the bottom part, the peelable cover part also being peelably sealed to a second cover part and provided with a gripping member. By gripping about the gripping member, the peelable cover sheet may be completely or partially removed from the package to allow easy access to the interior thereof. By not completely removing the upper cover sheet, said sheet may be used to reclose the package. However, the closure obtained thereby is not very tight, as subsequent to peeling, the peelable part tends to fold or crease, thus preventing abutment thereof with the rim of the bottom part.

Moreover, a package is known comprising a cup-shaped bottom part sealed by means of a peelable cover sheet peelably sealed to the rim of the bottom part, and a separate cover arranged on top of the cover sheet and interengaged with the rim of the bottom part. This additional cover serves to reclose the package subsequent to opening thereof by peeling of the peelable cover sheet. This solution is expensive due to the additional separate cover.

Furthermore, EP 0 488 452 discloses a package (confer FIGS. 3 and 3*b*) comprising a tray-shaped bottom part and a cover fixed to the rim of the bottom part along a circumferential sealing seam. The cover part is peelably sealed to the rim of the bottom part in a first zone A and fixedly sealed to the rim of the bottom part in a second zone. The varying strength of the sealing seam in the two zones is obtained by controlling the sealing temperature and/or sealing pressure. The seams of the two zones connect at points arranged on a line extending across the opening of the bottom part. Even though it is not described, it is seems obvious from FIG. 3*a* and FIG. 3*b* that a detachable tab of the bottom part outside the seam is attached to the cover part to form a gripping member. Thus, the cover part is formed of a single sheet layer.

Finally, EP 0 093 442 discloses a lid construction for a container comprising a cover member adapted to be secured to the upper open end of a container. The cover member is provided with a tongue defined by a curved cut and a perforated line, the tongue pivotting upwards about said line to form an opening in the cover member. The lid construction further comprises a main paperboard insert secured to the top surface of the cover member and provided with an end area superposed over the tongue. The main paperboard insert is provided with a hinge line being substantially superposed immediately above the perforated line in the cover member. A secondary paperboard insert having a pull tab is arranged between the main paperboard insert and the cover member and extends from the rim of the main paperboard insert to the hinge line. The secondary paperboard insert is secured to the tongue of the cover member such that said tongue and the superposed end area of the main paperboard insert pivot about their respective hinge lines when the pull tab is pulled to form the opening in the cover member. The publication thus relates to a completely different and more complicated type of lid construction than the present invention.

BRIEF DESCRIPTION OF THE INVENTION

The object of the invention is to provide a simple and economical package of the above type, which is recloseable so that it without further measures may be used for storing its contents after a portion thereof has been removed.

The package according to the invention is characterised in that the peelable cover part is formed more rigidly than the first plastic sheet and the peelable cover part comprises an additional rigidity-increasing sheet sealed to the first sheet and that and the rigidity-increasing sheet extends over essentially the entire peelable cover part. As a result, the first flexible plastic sheet forms an axis of rotation for the peelable cover part in the portion at the connecting line between the two terminal points of the peelable sealing line, when it has been peeled to the more firm sealing lines. The more rigid portion of the cover part prevents the cover part from creasing or folding after peeling. Moreover, due to the increased weight of the peelable cover in the rigid portion abutment of the cover part with the rim of the bottom part is ensured, when the package is reclosed after the initial opening thereof. Consequently, a good protection of the packaged product is obtained, also after the package has been opened.

According to the invention, the rigidity-increasing sheet may be sealed to the first sheet along an overlapping edge portion.

Moreover, according to the invention, the rigidity-increasing sheet may be sealed to the first sheet along a sealing line between the two sheets coincident with the peelable sealing line between the peelable cover part and the bottom part. This embodiment is considered particular advantageous in that it allows for sealing of the rigidity-increasing sheet to the first sheet and of the cover part to the bottom part in a single sealing operation.

Furthermore, according to the invention, the rigidity-increasing sheet may be formed of a inwards folded flap of the first sheet. By folding the flap inwards, i.e. to face the bottom part, the complete cover may be formed of a single sheet, one surface thereof thus being sealable to itself, and a second surface peelably sealable to the bottom part.

Further, according to the invention, the rigidity-increasing sheet may be provided on the lower face of the first sheet.

In this connection, it is preferable that the rigidity-increasing sheet is provided with a lower face forming a peelably seal with the rim of the bottom part when sealed, and an upper face forming a firm seal with the lower face of the first sheet when sealed.

Moreover, according to the invention, the peelable cover part and the bottom part may comprise co-acting locking means. The locking means serve to additionally ensure that the peelable cover part is kept in sealing abutment with the rim of the bottom part, when the package is reclosed after the initial opening thereof. The co-acting locking means may e.g. be formed of a downwardly facing projection on the cover part adapted to be brought into retaining engagement with a corresponding depression in the rim of the bottom part.

Finally, according to the invention, the peelable cover part may extend beyond the sealing line with the rim of the bottom part so as to form a gripping member in the portion being furthest spaced apart from the terminal points of the sealing line. By gripping about the gripping member, the peelable cover part may be easily peeled to its terminal points.

BRIEF DESCRIPTION OF THE DRAWINGS.

The invention is explained in detail below with reference to the drawings, in which.

BEST MODE FOR CARRYING OUT THE INVENTION

Figure 1:
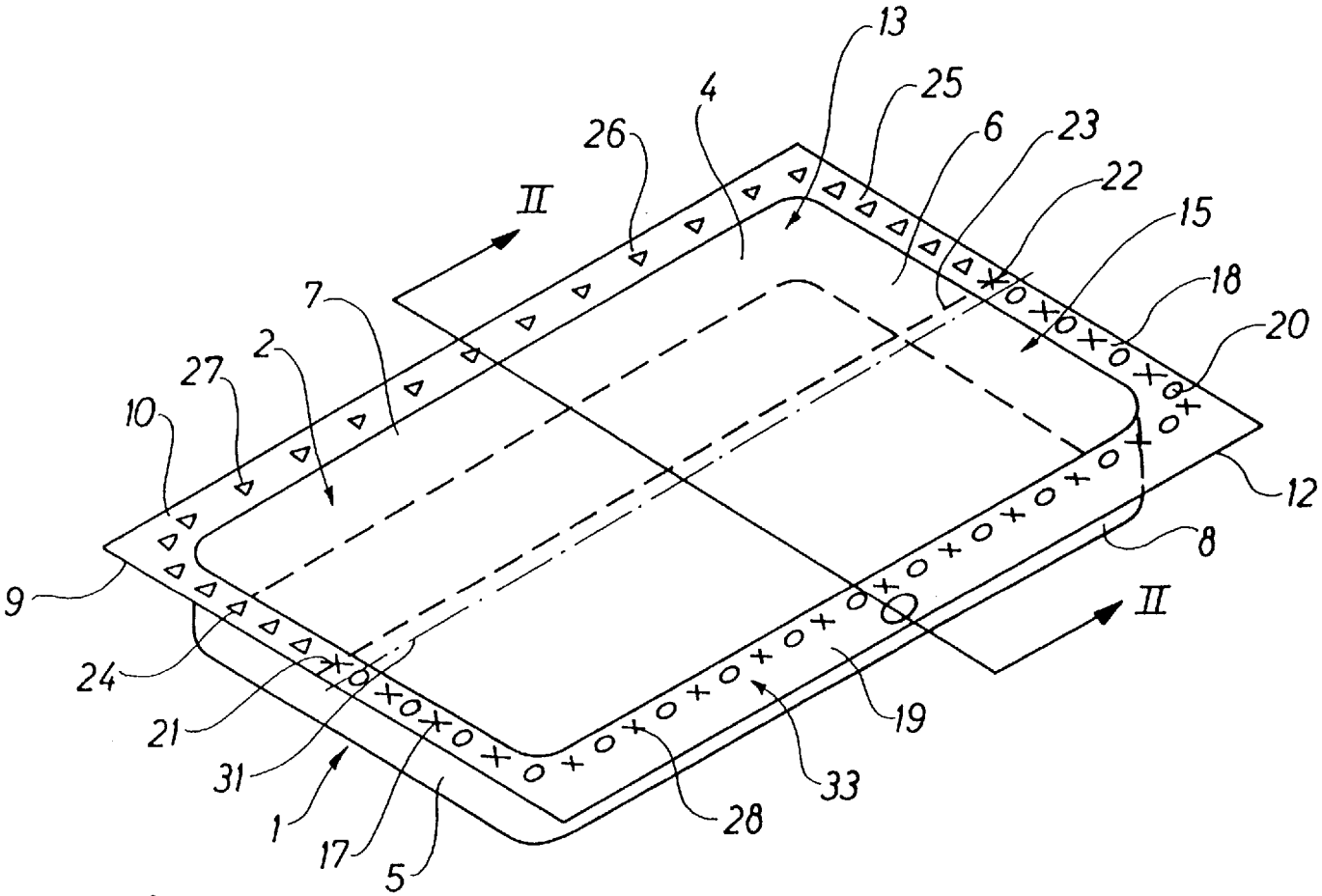
FIG. 1 is a isometric view of a preferred embodiment for a package according to the invention.
Figure 2:
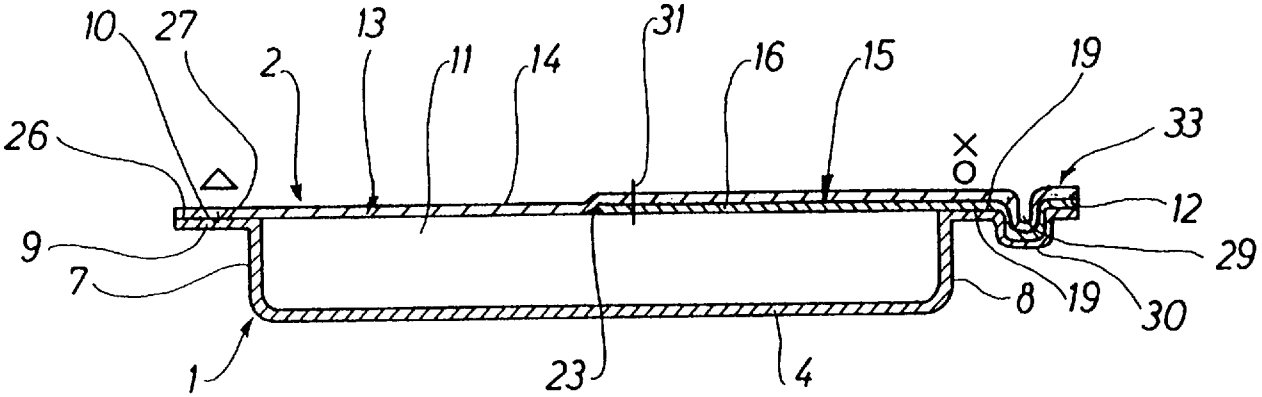
FIG. 2 is a sectional view along the line II—II in FIG. 1.

The package according to the invention shown in FIGS. 1 and 2 comprises a tray-shaped bottom part 1 and a cover 2.

The tray-shaped bottom part 1 is rectangular and comprises a bottom 4 and two pairs of opposing side walls 5,6 and 7,8 extending upwards from the bottom 4 and and continuing at their upper ends into a common flange 9 forming the upper rim 10 of the bottom part. Furthermore, at their upper ends, the side walls define the opening 11 of the bottom part. Finally, at the wall 8, the flange portion 12 is more wide than the rest of the flange 9.

The cover 2 comprises a first cover part 13 formed of a first flexible plastic sheet 14, and a second cover part 15 formed of a second more rigid plastic sheet 16 and the first plastic sheet 14, the latter extending onto the second plastic sheet in an entirely overlapping manner.

The more rigid plastic sheet 16 is sealed peelably to the rim 10 of the bottom part 1 along a section 12 of the rim portion at the wall 5, a section 18 of the rim portion at the wall 6 and to the entire rim portion 19 at the wall 8 by means of a first sealing line 20 illustrated by means of o'es. The sealing line extends between terminal points 21, 22 arranged on a line 23 extending centrally across the opening 11 of the bottom part 1.

The first plastic sheet is sealed firmly to the remaining section 24 of the rim portion at the wall 5; the remaining section 25 of the rim portion at the wall 6; and to the entire rim portion 26 at the wall 7 by means of a second sealing line 27 illustrated by means of triangles. Moreover, the first plastic sheet 14 is sealed firmly to the second more rigid plastic sheet 16 along a third sealing line 28 illustrated by means of x'es and situated above the first sealing line 20. It should be noted that the term firmly sealed denotes a seal substantially stronger than a peelable seal, but not necessarily a fusion seal.

The second rigid plastic sheet 16 and the first flexible plastic sheet 14 both extend beyond the sealing lines 20 and 28 in the wide flange portion 12, whereby a tab 33 is formed, which may be gripped about for opening the package. Further, in the tab 33, a downwards projection 29 is provided in the rigid plastic sheet 16 and in the first plastic sheet 14, said projection being in retaining engagement with a corresponding depression 30 in the wide flange portion 12.

By gripping about the tab 33 of the first plastic sheet 14 and the second plastic sheet 14, the second cover part 15 formed of said two plastic sheets may be peeled up to the terminal points 21, 22 of the first peelable sealing line 20. Subsequently, the second cover part 15 may be turned as a flap about the line 23 between the points 21, 22 and remain in the opened position, in which it abuts the first cover part 13. Due to its weight, the second cover part 15 remains in said opened position, until it is returned once more to its closed position about the line 23. Owing to its weight and rigidity, in its closed position, the cover part 15 essentially abuts the subjacent rim portions 17, 18, 19 of the bottom part 1 and closes the package. With a view to obtaining a more secure and tight closure of the package, the projection 28 may be brought into engagement with the depression 30, said parts forming a locking means for interlocking the second cover part 15 and the bottom part 1.

In a modification of the embodiment of the invention shown in FIGS. 1 and 2, the first flexible plastic sheet 14 merely extends slightly onto the second more rigid plastic sheet 16 and is sealed thereto by means of a transverse fourth sealing line 31 shown by means of a dotted line in FIG. 1 and slightly spaced apart from the line 23 in the overlapping portion between the two sheets. In this embodiment, it is necessary to seal the two sheets to each other, prior to the joint sealing thereof to the rim of the bottom part. However, said procedure is not necessary in the first embodiment. By a suitable selection of the surfaces of the sheets facing each other, the two sheets may be sealed to each other at the same time as the second rigid plastic sheet 16 is sealed peelably to the rim and the first flexible sheet is sealed firmly to the rim of the bottom part. The first embodiment of the invention is, further, preferable, when several, adjacent packages are to be formed, filled and sealed simultaneously, the number of webs comprising the two sheets thus being reduced. As an example, for manufacturing two adjacent packages arranged laterally reversed relative to each other, only two webs are required, viz. a web comprising the first flexible plastic sheet and having the double width of the individual package, and a web comprising the rigid second plastic sheet and having the double width of the peelable cover part of the end package. The two adjacent packages are separated subsequent to being formed, filled and sealed.

The tray-shaped bottom part 1 can be made of an arbitrary flexible, semi-rigid or rigid material. However, for some fields of application, it is preferable to use a semi-rigid or rigid laminate, such as a PE/PA laminate or a PE/PET laminate thermoformed into the desired shape, the PE layer facing inwards, and of a thickness of e.g. 100 to 400 $\mu$m. For the first flexible plastic sheet it is preferable to use a comparatively flexible sheet, such as a PETP/PE, an OPP/PE or a PA/PE laminate of a thickness of 40 to 100 $\mu$m, the PE layer facing inwards. For the more rigid second sheet 14, a LDPE/HDPE/LD peelable PE may be used having a thickness of 100 to 200 $\mu$m, the PE layer facing inwards. Moreover, the sheets may comprise a barrier layer, for instance a metallization.

Figure 3:
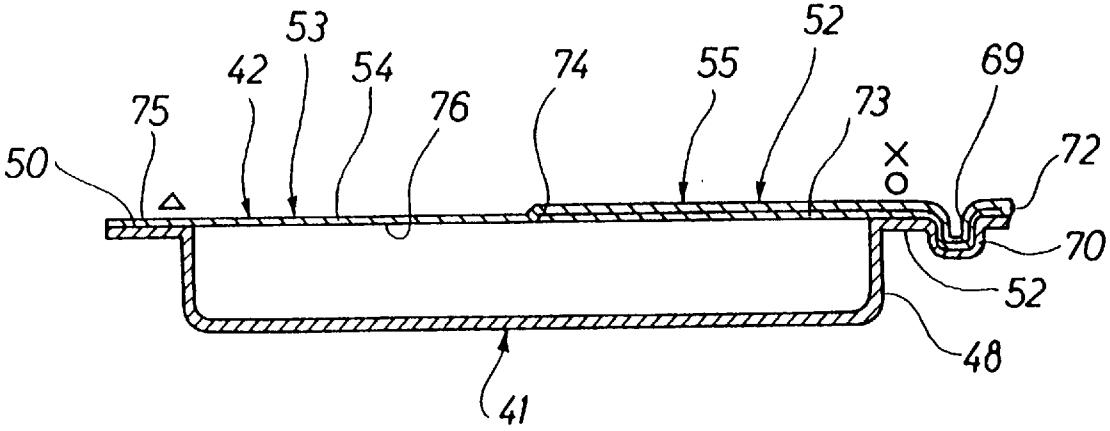
FIG. 3 is a sectional view corresponding to II—II in FIG. 1 through a second embodiment of a package according to the invention.

The embodiment of the package according to the invention shown in FIG. 3 comprises a bottom part 41 corresponding to the bottom part 1 described with reference to FIGS. 1 and 2, for which reason it is not described further. The cover 42 is formed of a single flexible plastic sheet 54 folded inwards onto itself about a folding line 74, the inwards folded flap 73 being the lowermost. The length of the inwards folded flap 73 is such that the free edge 74 thereof extends centrally across the opening of the bottom part 41.

The flexible sheet 54 is provided with a first outwards facing surface 75 sealing peelably to the rim 50 of the bottom part 41 when sealed, and a second inwards facing surface 76 sealing firmly to itself and to the rim 50 of the bottom part 41 when sealed. As a result, at the sealing of the folded sheet 54, the portion 53 of the cover 42 formed of a single layer of the sheet 54 is sealed firmly to the rim of the bottom part, while the double-walled portion 55 of the sheet is sealed peelably to the rim of the bottom part 41. The portion 53 thus forms the firmly sealed cover part, and the portion 55 forms the peelably sealed cover part of the cover 52 respectively. The sealing of the cover part 52 and the position of the sealing lines between said part and the rim 50 of the bottom part 41 is as described above with reference to FIGS. 1 and 2, for which reason no further description thereof is rendered. However, it should be noted that as the bottom part 1 in FIGS. 1 and 2, the bottom part 41 is provided with a more wide flange portion 52 at the side wall 48, a depression 70 being formed therein, and that a downward projection 69 in the cover 52 is adapted to be brought into retaining engagement therewith.

Due to its double wall thickness, the rigidity of the peelable cover part 52 is such that after being peeled it serves as a flap which can be turned about a line coincident with the free edge 74 of the folded flap 73, said edge defining the transition between the firm and the peelable sealing of the cover 52 to the rim 50 of the bottom part 41. Correspondingly, as a consequence of its increased rigidity and weight, the peelable cover part 52 tightly abuts the rim of the bottom part, when it reverts to its closed position subsequent to the initial opening thereof.

As an example, the first flexible sheet 55 may be formed of a peelable PE/PETP/PE, a peelable PE/OPP/PE, a peelable PE/PA/PE, or a co-extruded OPP/PE laminate having a thickness of 40 to 100 $\mu$m, the peelable PE layer facing outwards in the firmly sealed cover part 53 and thus inwards in the peelably sealed cover part 55. For the bottom part 41 the same co-extrudate as stated for the bottom part in the first embodiment may be used.

Figure 4:
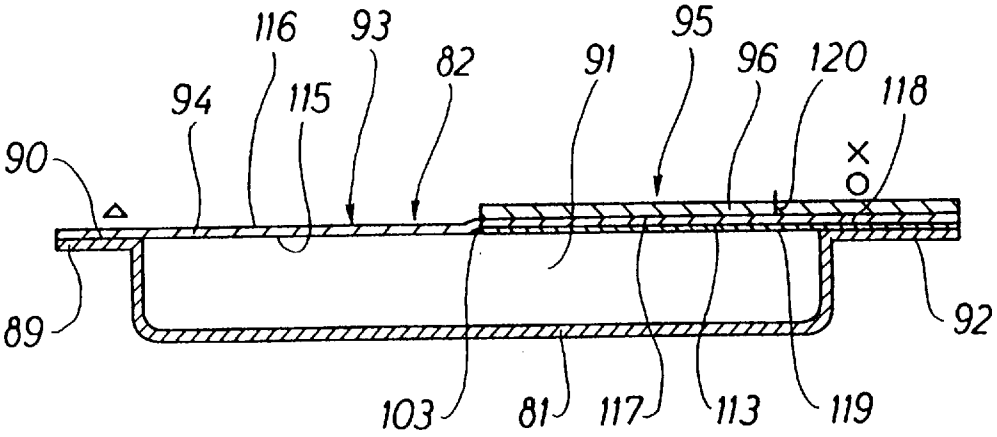
FIG. 4 is a sectional view corresponding to II—II in FIG. 1 through a third embodiment of a package according to the invention.

The embodiment of a package according to the invention shown in FIG. 4 comprises a tray-shaped bottom part 81 corresponding to the bottom part in the first embodiment, except for not being provided with a depression 30. The cover 82 comprises a first plastic sheet 94 having an extent corresponding to the outline of the flange 89 of the bottom part 81. A second more rigid plastic sheet 96 is sealed to the upper face of the first sheet 94, and a third flexible sheet 113 is sealed to the lower face of the first flexible sheet 94. The two sheets 96 and 113 both extend from the wide flange portion 92 of the bottom part 81 to approximately the middle of the opening 91 of the bottom part 81 and of essentially the same extent.

The first sheet 94 has a lower surface 1 15 sealing firmly to the rim 90 of the bottom part when sealed, and an outer surface 116 sealing firmly to the lower face 117 of the second more rigid sheet 96 and to the upper face 118 of the third flexible plastic sheet 113 when sealed. Finally, the third flexible sheet 113 is provided with a lower face 119 sealing peelably to the upper rim 90 of the bottom part when sealed.

When sealing the cover 82 to the rim 90 of the bottom part 81, as described above with reference to the first embodiment shown in FIGS. 1 and 2, the portion 93 of the cover formed only of the first plastic sheet 94 is sealed firmly to the rim 90, while the portion 95 of the cover 82 formed of the remaining portion of the first flexible sheet 94; the second more rigid sheet 96 as well as the third flexible sheet 112 are sealed peelably to the rim 90 of the bottom part 81. At the same time, the second rigid sheet 96 and the third flexible sheet 113 are sealed firmly to the remaining portion of the first flexible sheet 94. The portion 93, wherein the first flexible sheet is firmly sealed to the rim 90 of the bottom part thus forms the firmly sealed cover part of the cover 82, while the portion 95, wherein the second rigid sheet 96 and the third flexible sheet 113 both are sealed to the first flexible 94, forms the peelable cover part of the cover 82.

The package is opened as described for the first embodiment by gripping about the tab of the peelable cover part 95 at the wide flange portion 92 and peeling the peelable seal to the inner edge face 103 of the third sheet 113. The portion of the firmly sealed cover part 93 immediately adjacent thereto thus forms an axis of rotation for the peelable cover part 95 ensuring good reclosability of package due to its rigidity and weight.

In a modification of the embodiment according to the invention shown in FIG. 4, the third sheet 113 may be replaced by a peel coating on the lower face 115 of the first sheet 94 in the portion corresponding to the third sheet 113.

Finally, it should be noted that the package may, naturally, be of any arbitrary form than rectangular, for instance oval or circular, and that the terminal points of the peelable sealing line may have an arbitrary position provided that the line therebetween extends across the opening of the bottom part. The package may be provided with two or more peelable cover parts, should this be considered advantageous for easy access to the packed product.

I claim:

1. A package comprising a tray-shaped bottom part (1, 41, 81) provided with an opening covered by a cover (2,42,82) sealed to the bottom part along a circumferential rim (10, 50,90) thereof to form a sealed compartment, and wherein the cover (2, 42, 82) to form a peelable cover part (15, 55, 95) is sealed peelably to the bottom part along a portion of the rim thereof by means of a first sealing line (20) extending between two terminal points (21,22) arranged on a line (23) extending across the opening of the bottom part (1, 41, 81), and wherein the cover (2,42,82) is sealed firmly to the rim (10,50,90) of the bottom part (1,41,81) by means of other sealing lines (27) at least in the rim portions of the bottom part immediately adjacent said points, and wherein the cover part (2, 42, 82) at least in the portion of said line (23) is formed of a first flexible plastic sheet (14,54,94), characterised in that the peelable cover part (15, 55, 95) is formed more rigidly than the first plastic sheet (14, 54, 94) and comprises a rigidity-increasing further sheet (16, 73, 96) sealed firmly to the first sheet (14, 54, 94), and that the rigidity-increasing sheet (16, 73, 96) extends essentially over the entire peelable cover part (15,55,95).

2. A package according to claim 1, characterised in that the peelable cover part (15, 55, 95) extends beyond the sealing line (20) with the rim (10,50, 90) of the bottom part to form a gripping member in the portion being furthest spaced apart from the terminal points (21,22) of the sealing line.

3. A package according to claim 1, characterised in that the rigidity-increasing sheet (16) is sealed to the first sheet (14) along an overlapping edge portion.

4. A package according to claim 1 or 3 characterised in that the rigidity-increasing sheet (16, 73, 96) is sealed to the first sheet (14, 54, 94) along a sealing line (27) between the two sheets, said sealing line being coincident with the peelable sealing line (20) between the peelable cover part (15, 55, 95) and the bottom part (1, 41, 81).

5. A package according to claim 1 or 3, characterised in that the rigidity-increasing sheet (73) is formed of a folded flap of the first sheet (54).

6. A package according to claim 3, characterised in that the rigidity-increasing sheet (73) is formed of a folded flap of the first sheet (54).

7. A package according to claim 3, characterised in that the rigidity-increasing sheet (16, 73, 96) extends essentially over the entire peelable cover part (15, 55, 95).

8. A package according to claim 3, characterised in that the rigidity-increasing sheet (16, 73) is provided on the lower face of the first sheet (14, 54).

* * * * *